United States Patent [19]

Kuo

[11] Patent Number: 4,888,967

[45] Date of Patent: Dec. 26, 1989

[54] BICYCLE LOCK

[76] Inventor: Li-Tsao Kuo, No. 16, Lane 459, Sec. 1, An Ho Rd., Tainan, Taiwan

[21] Appl. No.: 288,219

[22] Filed: Dec. 22, 1988

[51] Int. Cl.[4] ..... E05B 67/38

[52] U.S. Cl. ..... 70/52; 70/54; 70/233; 70/417

[58] Field of Search ..... 70/417, 51–56, 70/233, 225–227

[56] References Cited

U.S. PATENT DOCUMENTS

| | | | |
|---|---|---|---|
| 980,798 | 1/1911 | Krajdocha | 70/51 |
| 1,515,302 | 11/1924 | George | 70/53 |
| 2,375,488 | 5/1945 | Olson | 70/54 |
| 2,904,985 | 9/1959 | Murphy | 70/51 |
| 3,597,944 | 8/1971 | Litvin | 70/53 X |
| 3,835,676 | 9/1974 | Foote | 70/417 X |
| 3,976,434 | 8/1976 | Shwayder | 70/417 X |
| 4,064,716 | 12/1977 | Shwayder et al. | 70/417 X |
| 4,180,996 | 1/1980 | Lebrecht | 70/417 X |
| 4,545,224 | 10/1985 | Zane | 70/233 X |
| 4,660,394 | 4/1987 | Wu | 70/53 X |

FOREIGN PATENT DOCUMENTS

| | | | |
|---|---|---|---|
| 323635 | 7/1920 | Fed. Rep. of Germany | 70/53 |
| 1260582 | 2/1968 | Fed. Rep. of Germany | 70/54 |
| 2415184 | 9/1979 | France | 70/417 |
| 1135192 | 12/1968 | United Kingdom | 70/417 |

*Primary Examiner*—Lloyd A. Gall

*Attorney, Agent, or Firm*—Lowe, Price, LeBlanc, Becker & Shur

[57] ABSTRACT

An easily manufactured, inexpensive, bicycle lock is provided with a U-shaped latch rod (3) with outside grooves (31) at its two ends, these ends being received into corresponding side holes of a tubular lock body (1) having a latitudinal hole. A protecting barrel (4) protrudes laterally of the lock body (1) to surround that end of the latch rod (3) inserted into one of the side holes to prevent easy breakage of the latch rod there. Covers (5) and (51) cover the lock body (1) (including the protruding barrel) and the latch rod (3) respectively. A lock core (2) engages one of the grooved ends of the latch rod (3) during use.

2 Claims, 5 Drawing Sheets

BICYCLE LOCK

BACKGROUND OF THE INVENTION

This invention relates to a bicycle lock and, in particular, to an improved bicycle lock that has no extensions of the lock shackle protruding from the lock body during use.

BACKGROUND OF THE PRIOR ART

Many bicycle locks use a U-shaped latch rod 9, for example per FIG. 4, to lock a bicycle wheel at a railing or an electric pole by engaging a lock body to prevent the bicycle from being stolen. One end 95 of the latch rod 9 of the prior art (shown as in FIG. 4) protrudes from the lock body 91 and can easily be broken by a thief using a tool to hammer it out.

An improved lock that has eliminated this defect of leaving a portion which protrudes from such locks as shown in FIG. 5, has a shortened U-shaped latch rod 9 and some clearance left in between the U-shaped latch rod 9 and the lock body 91. Therefore, by using the lever principle, a thief can easily break such locks with a hard tool.

There is, therefore, a need for an improved bicycle lock which has a protecting barrel at the lock body to prevent the shackle from being hammered out or broken.

SUMMARY OF THE INVENTION

It is a primary object of the present invention to provide an improved bicycle lock utilizing a protecting barrel on a shackle portion to prevent the lock from being hammered open.

It is another object of the present invention to provide an improved bicycle lock utilizing a protecting barrel to prevent the lock from being levered open.

It is still another object of the present invention to provide an improved bicycle lock which has a cover 5 that covers the lock body and the U-shaped latch rod to protect them from being damaged by impacts with other objects or rusting.

It is still another object of the present invention to provide an improved bicycle lock which is easy to use.

It is a further object of the present invention to provide an improved bicycle lock which is inexpensive to produce.

DETAILED DESCRIPTION OF THE PREFERRED EMBODIMENT

Figure 1:
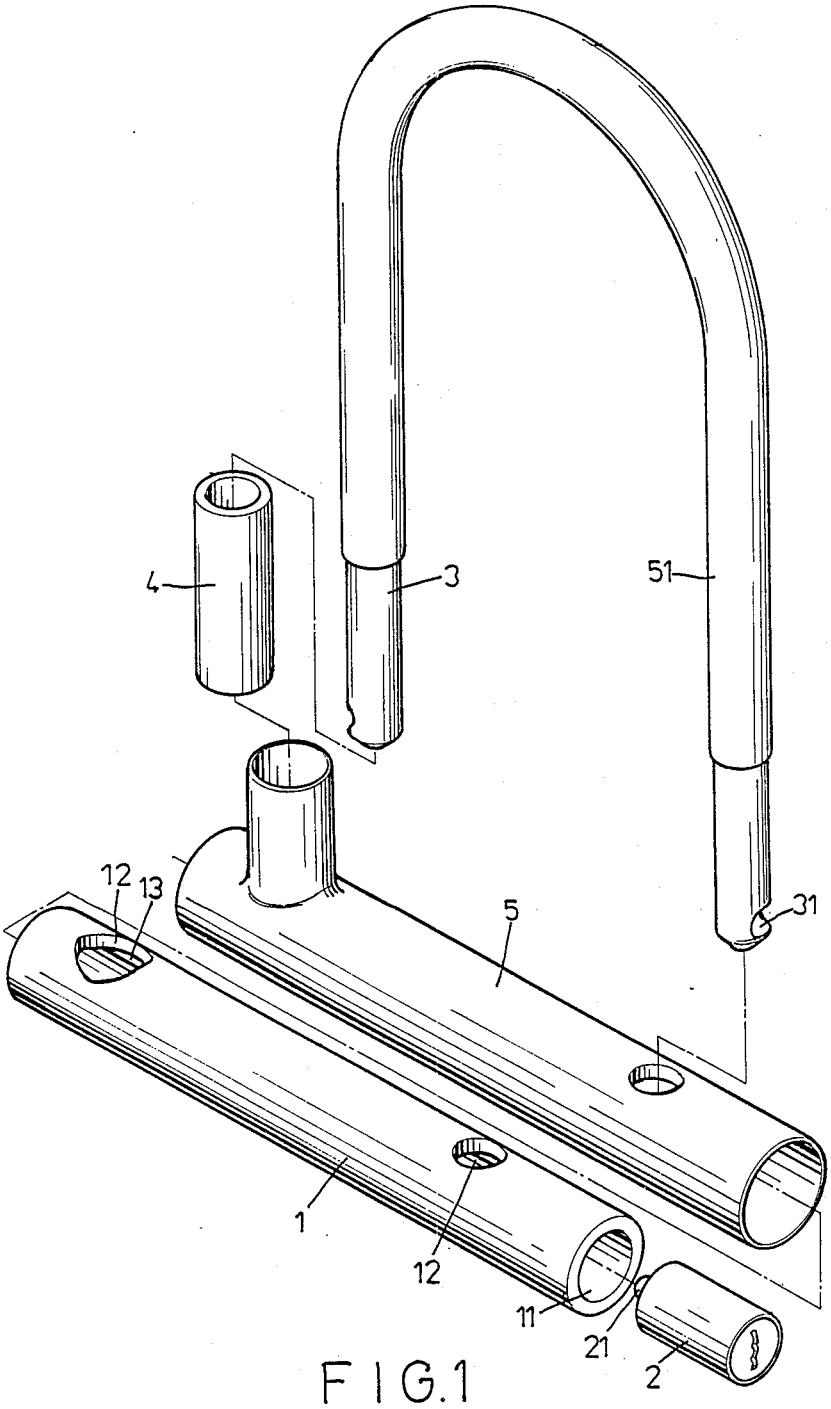
FIG. 1 is an exploded view of a preferred embodiment of the present invention.

With reference to the drawings and in particular to FIG. 1 thereof, the improved bicycle lock according to the present invention comprises a lock body 1 and a U-shaped latch rod 3.

The lock body 1 has a latitudinal hole 11 and two troughs 12 for the insertion of the two legs of the U-shaped latch rod 3. One end of the lock body 1 is for the insertion of a lock core 2 which has an actuating member 21 at one end. One of the two troughs 12 has a scarf trough 13. The lock body 1 has a cover 5 which also has a latitudinal hole of which the inner diameter is larger than the outer diameter of the lock body 1 so that the lock body can be placed within the cover 5.

The cover 5 further has a hole and a protruding open portion that align with the two holes 12 of the lock body 1. A lock core 2 is to be placed in one end of the latitudinal hole 11 having the hole 12. The lock core 2 has an actuating member 21 which is well known in the art and will not be described hereinafter.

The U-shaped latch rod 3 is a solid rod and has two outside grooves 31 at the respective ends of its two legs. The latch rod 3 is also wrapped with a cover 51 which is to protect the latch rod from being nicked or damaged by rusting.

Figure 2:
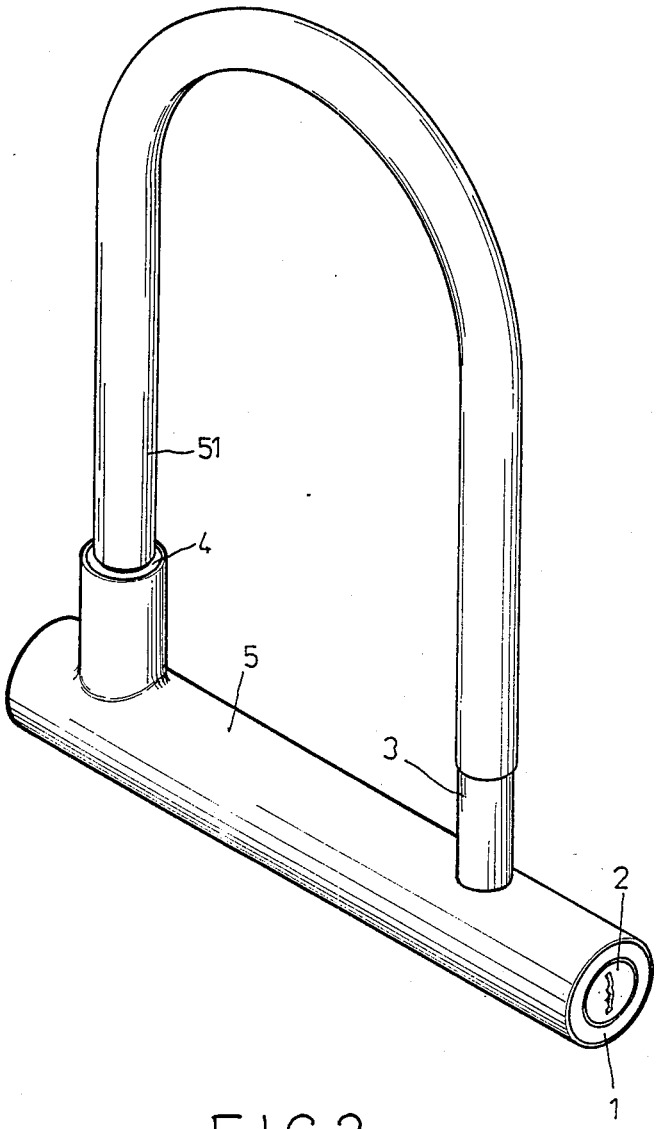
FIG. 2 is a perspective view of the present invention per FIG. 1.

A protecting barrel 4 is inserted into the intruding portion of the cover 5 and extends all the way down to the scarf trough 13. Thus, when the legs of the U-shaped latch rod 3 are inserted into the lock body, one of the legs will be surrounded by the protecting barrel 4 to prevent the lock being easily broken thereat and the other leg will engage at its groove 31 with the actuating member 21 of the lock core 2, as best seen in FIG. 2.

Figure 3:
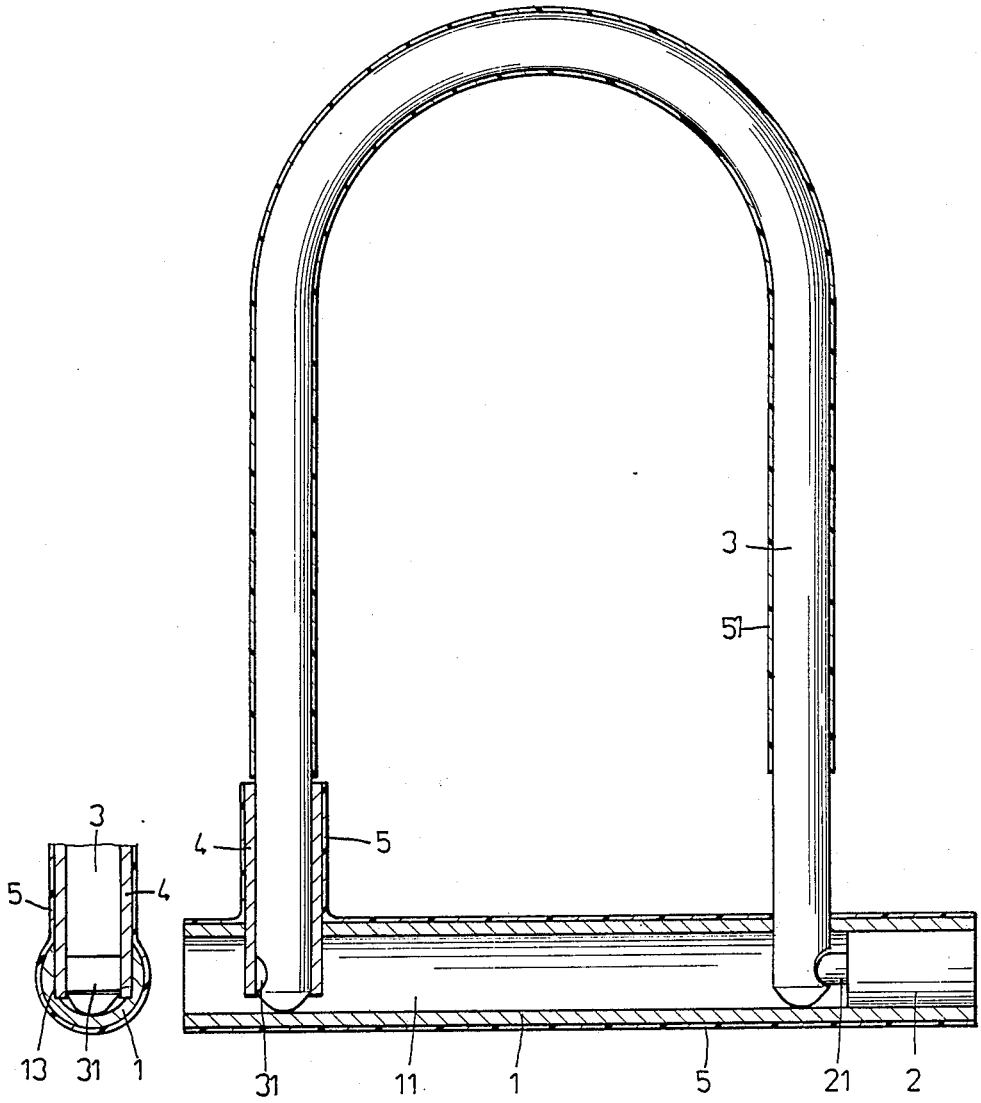
FIG. 3A is a front sectional view of the present invention per FIG. 1.
FIG. 3B is a side sectional view of the present invention per FIG. 1.
Figure 4:
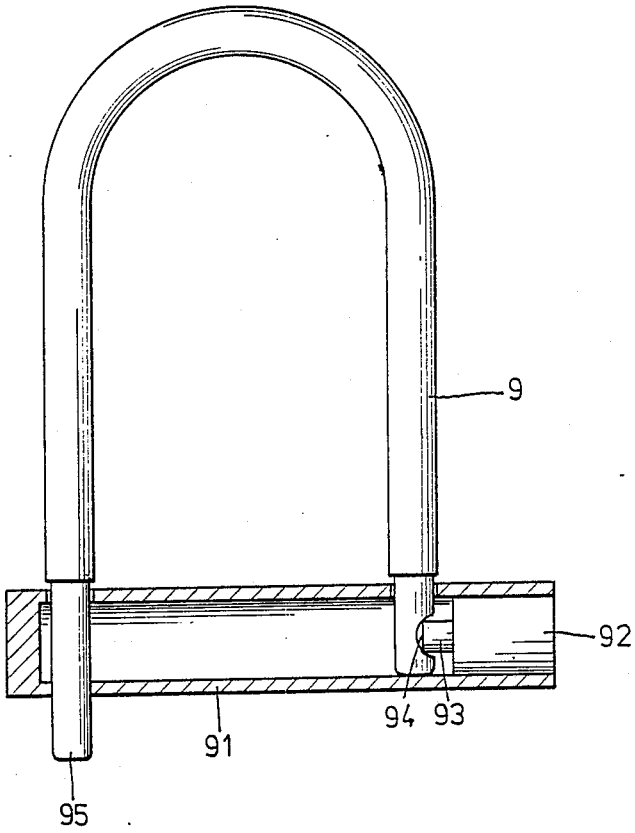
PRIOR ART FIG.4
FIG. 4 is a front sectional view of a lock according to the prior art.
Figure 5:
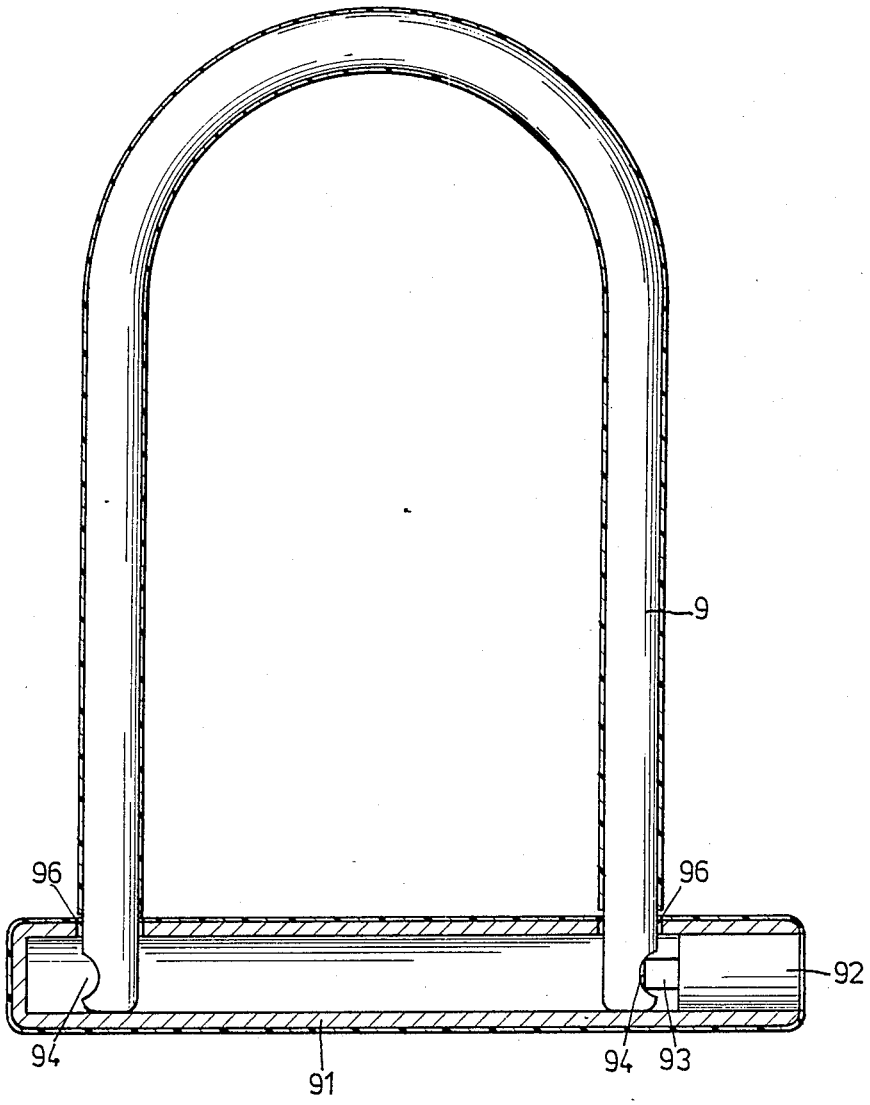
PRIOR ART FIG.5
FIG. 5 is another front sectional view of another prior art lock.

Reference now may be had to FIG. 3 which is a front sectional view of the present invention. When in use to lock a bicycle, for instance, the U-shaped latch rod 3 is inserted between two spokes of a wheel of a bicycle and then the two legs of the U-shaped latch rod 3 are inserted into the lock body 1 and the bicycle lock of the present invention is in locked position. When it is desired to release the lock of the present invention from the bicycle, it is necessary only to insert a proper key into the lock core 2 to release the actuating member 21 of the core 2 and the U-shaped latch rod 3 may then be easily drawn out from the lock body 1.

Still other objects and advantages of the present invention will become readily apparent to those skilled in this art from the preceding detailed description, wherein only the preferred embodiments of the invention are illustrated and described, as aforementioned, simply by way of presenting the best modes contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive, the invention being defined solely by the claims appended hereto.

I claim:

1. An improved bicycle lock, comprising:

a lock body having a latitudinal hole through the body, two holes at one side and a scarf trough in one of said two holes, and a cover;

a lock core having an actuating member at one end, inside one end of the latitudinal hole of said lock body;

a U-shaped latch rod, having an outside groove at the end of each of two legs and a cover; and a substantially cylindrical protecting barrel inserted into said scarf trough of said lock body through said one of said side holes thereof and extending outwardly of said lock body to receive one of said grooved ends of said latch rod to prevent deliberate breakage of said latch rod thereat.

2. An improved bicycle lock according to claim 1, wherein:

said lock body cover is formed to extend over said outwardly extended portion of said protecting barrel and coacts with the cover of said U-shaped latch rod to protect the lock from being scratched by impacts with objects or by rusting.

* * * * *